US009098011B2

(12) United States Patent
Okumura

(10) Patent No.: US 9,098,011 B2
(45) Date of Patent: Aug. 4, 2015

(54) DEVELOPMENT DEVICE

(75) Inventor: Shohei Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 13/344,939

(22) Filed: Jan. 6, 2012

(65) Prior Publication Data

US 2012/0189357 A1 Jul. 26, 2012

(30) Foreign Application Priority Data

Jan. 26, 2011 (JP) ..... 2011-013965

(51) Int. Cl.
*G03G 15/08* (2006.01)

(52) U.S. Cl.
CPC .... *G03G 15/0813* (2013.01); *G03G 2215/0129* (2013.01)

(58) Field of Classification Search
CPC ..... G03G 15/0813; G03G 2215/0129
USPC ..... 399/270, 271, 274, 275, 284, 285
See application file for complete search history.

(56) References Cited

U.S. PATENT DOCUMENTS

| | | | | |
|---|---|---|---|---|
| 5,428,428 | A * | 6/1995 | Haneda | 399/276 |
| 5,602,630 | A * | 2/1997 | Endo et al. | 399/271 |
| 5,682,585 | A * | 10/1997 | Yamaguchi et al. | 399/274 |
| 2014/0169839 | A1 * | 6/2014 | Nakayama et al. | 399/274 |

FOREIGN PATENT DOCUMENTS

| | | | |
|---|---|---|---|
| JP | 62-023867 | B | 5/1987 |
| JP | 1-302283 | A | 12/1989 |
| JP | 04-070874 | A | 3/1992 |
| JP | 07-146603 | A | 6/1995 |
| JP | 07-152247 | A | 6/1995 |
| JP | 7-333976 | A | 12/1995 |
| JP | 09-236986 | A | 9/1997 |
| JP | 2860104 | B2 | 2/1999 |
| JP | 3087541 | B2 | 9/2000 |

* cited by examiner

*Primary Examiner* — Rodney Bonnette

(74) *Attorney, Agent, or Firm* — Fitzpatrick, Cella, Harper & Scinto

(57) ABSTRACT

A typical configuration of a development device for an image forming apparatus includes a development sleeve and an electrode portion. In the development device, a pre-bias is applied between the electrode portion and the photosensitive drum, a DC voltage is applied to the development sleeve, a development bias is applied between the development sleeve and the photosensitive drum, the toner in the developer on the development sleeve is moved to the photosensitive drum, and an electrostatic latent image is developed on the photosensitive drum. In the development device, the electric field intensity between the electrode portion and the development sleeve by the pre-bias is larger than the electric field intensity between the image bearing member and the development sleeve by the development bias.

4 Claims, 13 Drawing Sheets

DEVELOPMENT DEVICE

BACKGROUND OF THE INVENTION

1. Field of the Invention

The present invention is directed to an image forming apparatus, such as a copying machine and a printer, in which an electrophotographic system is utilized and a development device used in the image forming apparatus.

2. Description of the Related Art

In an electrophotographic image forming apparatus of the related art, charged toner is brought close to an image bearing member, and the toner is caused to adhere electrostatically to an electrostatic latent image on the image bearing member, thereby performing development to form an image. A two-component developer mainly containing non-magnetic toner and a magnetic carrier is widely used as a developer.

A development bias that moves the developer to the image bearing member includes an AC development in which an AC voltage is superimposed on a DC voltage and a DC development in which only the DC voltage is utilized. While the AC development is excellent for image quality, the DC development has advantages in a simple configuration and low cost.

For example, a bias in which the rectangular-wave AC voltage of about $V_{p-p}$=2 kV is superimposed on the DC voltage of about 200 V is used in a two-component AC development method in which the two-component developer is used. A DC component of the development bias is applied in order to send the toner in the developer on a surface of a developer bearing member toward the image bearing member. On the other hand, an AC component has an effect that separates the toner and carrier, which are charged in opposite-polarities, in the developer by instantaneously applying a large electric field.

The development is performed only by the DC voltage in a two-component DC development method in which the two-component developer is used. Because the DC voltage of the two-component DC development method is smaller than the AC voltage of the two-component AC development method, the separation action of the development bias on the toner and the carrier is small. Therefore, a small number of toner particles can move under the development bias, and the amount of toner developed in the image bearing member is inevitably decreased to hardly obtain desired image density.

For example, a method for increasing a toner concentration in the developer, a method for enhancing a developer conveying speed of the developer bearing member, and a method for increasing the development bias are proposed in order to improve the image density. However, when the toner concentration is increased in the developer, what is called a fog in which the toner adheres to a non-image region on the image bearing member is easy to generate. When the developer conveying speed is enhanced, it is well known that degradation of the developer is accelerated.

When the development bias is increased, because a force acting on the toner is increased, a separation characteristic of the toner and the carrier can be improved to increase the image density. However, because a probability that the carrier adheres to an image region on the image bearing member is significantly increased, there is a limitation to the increase in image density by increasing the development bias.

In Japanese Patent Laid-Open No. 4-70874, an excitation electrode is provided in front of the development region in order to attract the toner in the two-component developer. Therefore, when the developer reaches the development region through an excitation electrode position, the toner in the developer is attracted onto the excitation electrode side to enhance the toner concentration of the developer that comes into contact with a photosensitive body.

However, in the technology of Japanese Patent Application Laid-Open No. 4-70874, the force moving the toner in the developer remains weak, and the electrode has only a small effect.

SUMMARY OF THE INVENTION

The present invention provides a development device that can effectively enhance the image density while suppressing the fog in the DC development method in which the development is performed using the DC bias.

The present invention provides a development device including a developer bearing member that is disposed opposite an image bearing member bearing an electrostatic latent image, and conveys a developer having toner and a carrier to a development region, a development bias applying device that applies a DC voltage to the developer bearing member, an electrode member that is disposed on an upstream side of the development region in a developer conveying direction, and a bias applying device that applies a DC voltage to the electrode member such that electric field intensity formed between the electrode member and the developer bearing member is larger than electric field intensity formed between a potential at an image portion of the image bearing member and the developer bearing member.

Further features of the present invention will become apparent from the following description of exemplary embodiments with reference to the attached drawings.

DESCRIPTION OF THE EMBODIMENTS

Figure 1:
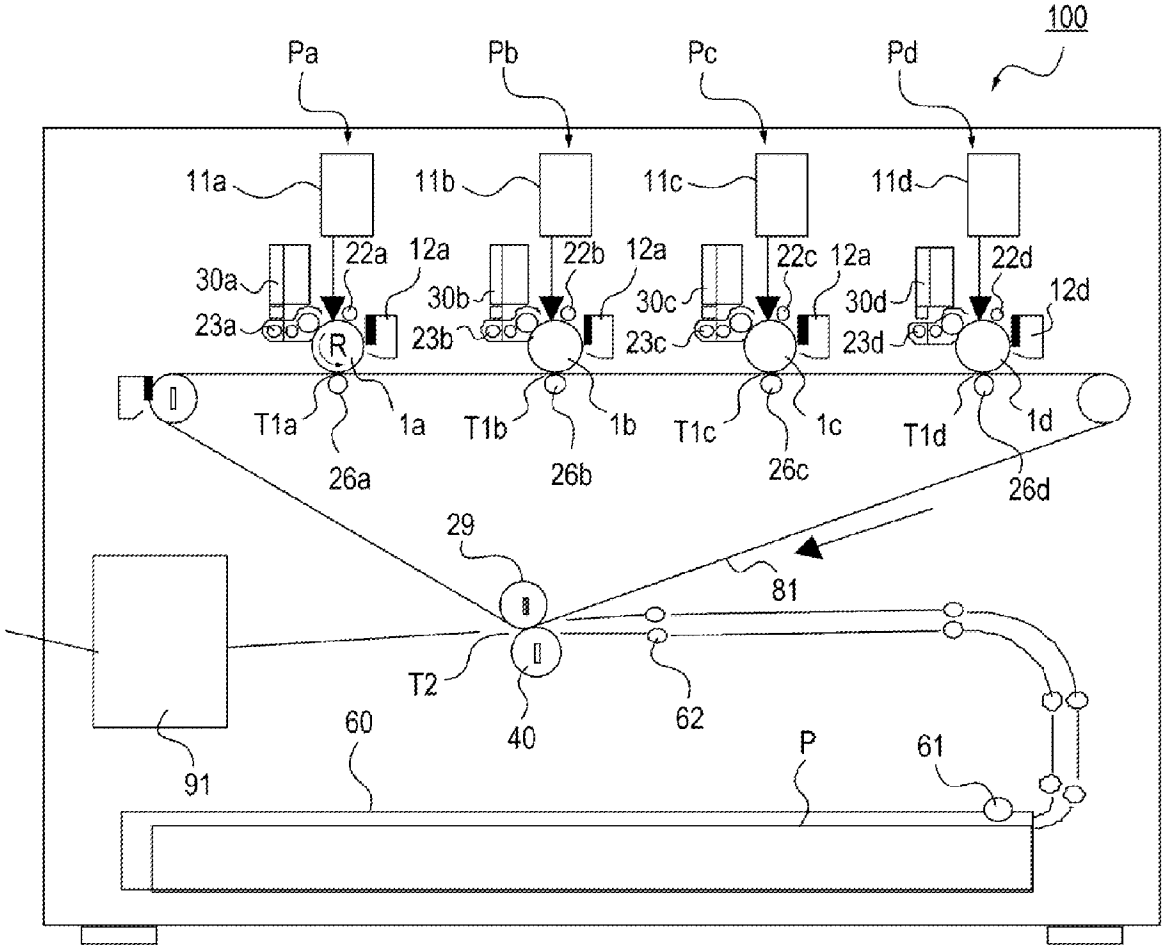
FIG. 1 is a configuration diagram of an image forming apparatus according to a first embodiment.

[First Embodiment] A development device and an image forming apparatus according to a first embodiment of the invention will be described with reference to the drawings. FIG. 1 is a configuration diagram of an image forming apparatus 100 of the first embodiment. As illustrated in FIG. 1, the image forming apparatus 100 of the first embodiment includes four image forming portions Pa, Pb, Pc, and Pd. Because the image forming portions Pa to Pd have the substantially same configuration, the image forming portion will be described by taking the image forming portion Pa as an example.

In the image forming portion Pa, a laser scanner 11*a* emits a laser beam according to an image signal of a yellow component color of an original, and an electrostatic latent image is formed on a photosensitive drum 1*a* (image bearing member) charged by a primary charger 22*a*. The electrostatic latent image is developed as a yellow toner image by a development device 23*a*. The yellow toner image is primary-transferred to an intermediate transfer belt 81 in a primary transfer nip portion T1*a* in which the intermediate transfer belt 81 nipped between a primary transfer roller 26*a* and the photosensitive drum (image bearing member) 1*a* abuts on the photosensitive drum 1*a*. After the primary transfer, the toner remaining on the photosensitive drum is removed by a cleaner 12. Magenta, cyan, and black toner images, which are similarly formed by the image forming portions Pb to Pd, are transferred to the intermediate transfer belt 81 bearing the yellow toner image while superimposed on the yellow toner image.

On the other hand, a sheet (recording medium) P stacked on a sheet cassette 60 is conveyed to a secondary transfer portion T2 in which a secondary transfer inner roller (transfer portion) 29 and a secondary transfer outer roller 40 abut on each other by a pickup roller 61 and a conveying roller 62, and the toner images of four colors are secondary-transferred to the sheet P. A fixing device 91 heats and pressurizes the toner image, thereby fixing the secondary-transferred toner image to the sheet P. Then the sheet P is discharged to the outside of the image forming apparatus main body.

Figure 2:
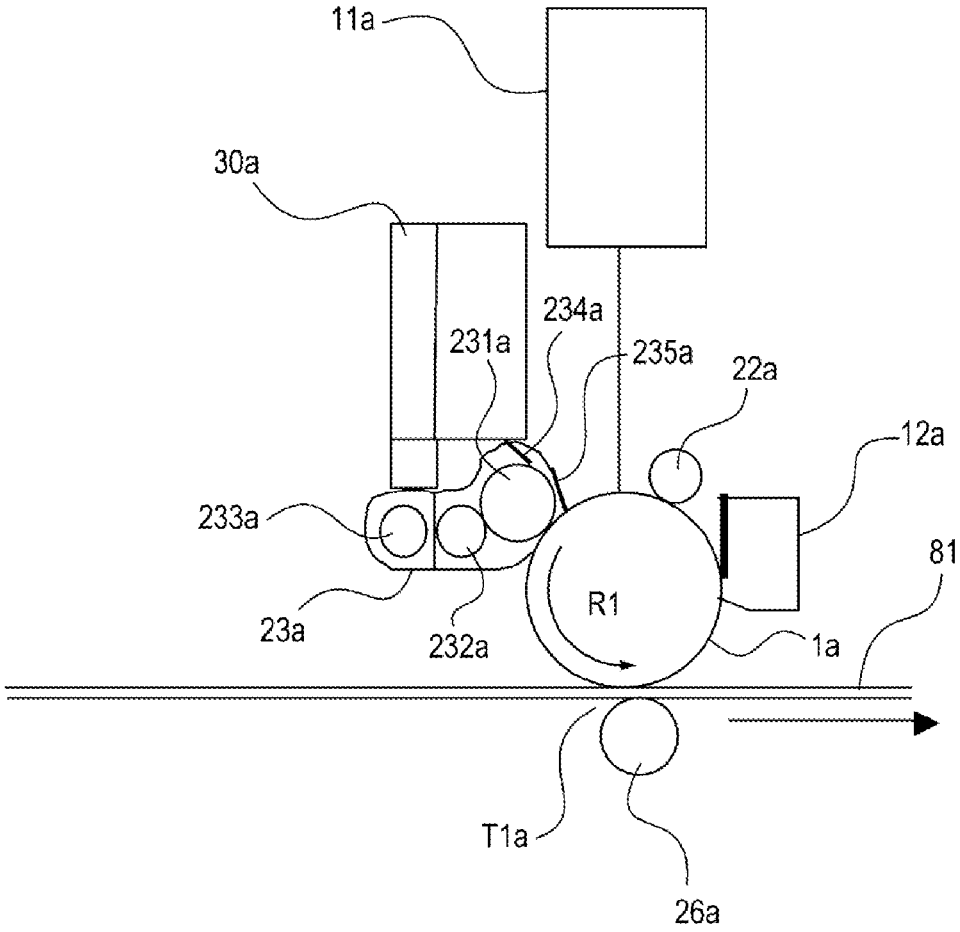
FIG. 2 is a configuration diagram of an image forming portion of the first embodiment.

As illustrated in FIG. 2, a two-component developer mainly containing non-magnetic toner and a magnetic carrier, which are negatively charged, is used in the development device 23*a* of the first embodiment. The development device 23*a* is partitioned into a first chamber (development chamber) and a second chamber (agitation chamber) by a partition that extends in a perpendicular direction at a development position. A non-magnetic development sleeve (developer bearing member) 231*a* is disposed in the first chamber, and a magnet that is of magnetic field generating unit is fixedly disposed in the development sleeve 231*a*.

First and second screws 232*a* and 233*a* are disposed in the first chamber and the second chamber, respectively. The first screw 232*a* agitates and conveys the developer in the first chamber. The second screw 233*a* agitates and conveys the toner supplied from a toner supply tank 30*a* and the developer in the development device 23*a*, thereby homogenizing toner concentration of the developer. In the partition between the first chamber and the second chamber, developer paths through which the first chamber and the second chamber are communicated with each other are formed in end portions on a front side and a rear side. The developer in the first chamber, in which the toner is consumed by the development to reduce the toner concentration of the developer, is moved to the second chamber through one of the paths by conveying forces of the first and second screws 232*a* and 233*a*. The developer whose toner concentration is recovered in the second chamber is moved to the first chamber through the other path.

The two-component developer in the development device 23*a* is borne on the development sleeve 231*a* (developer bearing member) by a magnetic force of the magnet. A layer thickness of the developer on the development sleeve 231*a* is regulated by a blade 234*a*, and the developer is conveyed to a development region that faces the photosensitive drum 1*a* in association with rotation of the development sleeve 231*a*. Magnetic poles of the magnet are disposed in a development region such that the two-component developer forms a magnetic brush, and the magnetic brush is brought into contact with the photosensitive drum 1*a* to supply the toner to the electrostatic latent image, thereby performing the development. In order to improve development efficiency, namely, a ratio of toner provided to the latent image, a predetermined development bias is applied to the development sleeve 221*a* from a development bias power supply (not illustrated) that is of a development bias output unit. In the first embodiment, only a DC voltage of −500 V is applied to the development sleeve 231*a* from the development bias power supply.

(Auxiliary Electrode) As illustrated in FIG. 2, in a developer conveying direction, an auxiliary electrode 235*a* is disposed on an upstream side of the development region where the photosensitive drum 1*a* and the development sleeve 231*a* face each other. The auxiliary electrode 235*a* is attached to the development device 23*a*.

Figure 3:
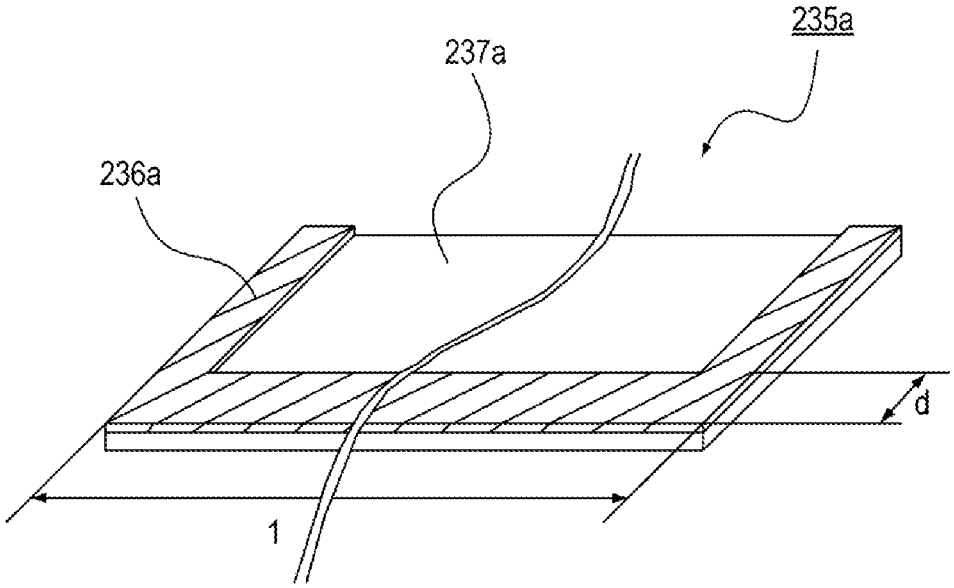
FIG. 3 is a configuration diagram of an auxiliary electrode of the first embodiment.

FIG. 3 is a configuration diagram of the auxiliary electrode 235*a*. As illustrated in FIG. 3, the auxiliary electrode 235*a* includes an electrode portion (electrode member) 236*a* and an electrode support member 237*a*. The electrode portion 236*a* is made of a metallic foil to which the voltage can be applied. The electrode support member 237*a* is made of an insulating resin. The electrode portion 236*a* is fixed onto the electrode support member 237*a* by a bonding agent.

A length 1 of the electrode portion 236*a* is larger than a developer bearing region of the development sleeve 231*a* in a longitudinal direction of the development sleeve 231*a*. Therefore, when the voltage is applied to the electrode portion 236*a*, an electric field is homogeneously formed over a whole region where the developer on the development sleeve 231*a* is borne in the longitudinal direction of the development sleeve 231*a*. A width d of the electrode portion 236*a* is adapted to be equal to a pre-bias applying range described below.

Figure 4:
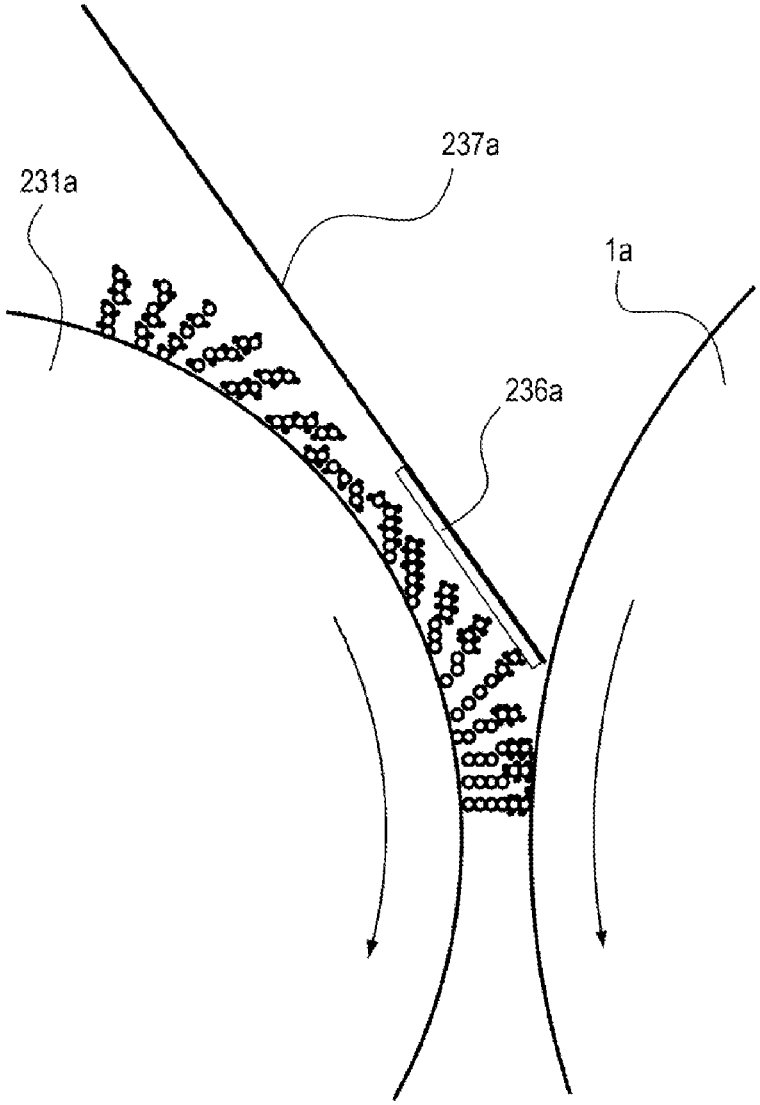
FIG. 4 is a schematic diagram illustrating an effect of the auxiliary electrode of the first embodiment.

The DC voltage (hereinafter referred to as a pre-bias) is applied between the electrode portion 236*a* and the development sleeve 231*a* such that a potential at the electrode portion 236*a* relative to the development sleeve 231*a* has an opposite-polarity to a charge of the toner in the developer. As illustrated in FIG. 4, when the developer passes by the auxiliary electrode 235*a*, the toner in the developer is pulled from the development sleeve side to the auxiliary electrode side by action of the electric field formed by the pre-bias. Therefore, the toner concentration of the developer on the auxiliary electrode side is higher than that of the developer on the development sleeve side. The developer having the high toner concentration comes into contact with the photosensitive drum 1*a*, and image density of the developed toner image is increased compared with a configuration in which the auxiliary electrode is not disposed.

(Pre-bias Applying Range) The pre-bias applying range will be described below. As described in Japanese Patent No. 3087541, even if the pre-bias is applied, sometimes high-efficiency development is not yielded depending on a positional relationship between the auxiliary electrode and the magnetic poles of the magnet in the development sleeve.

Figure 5:
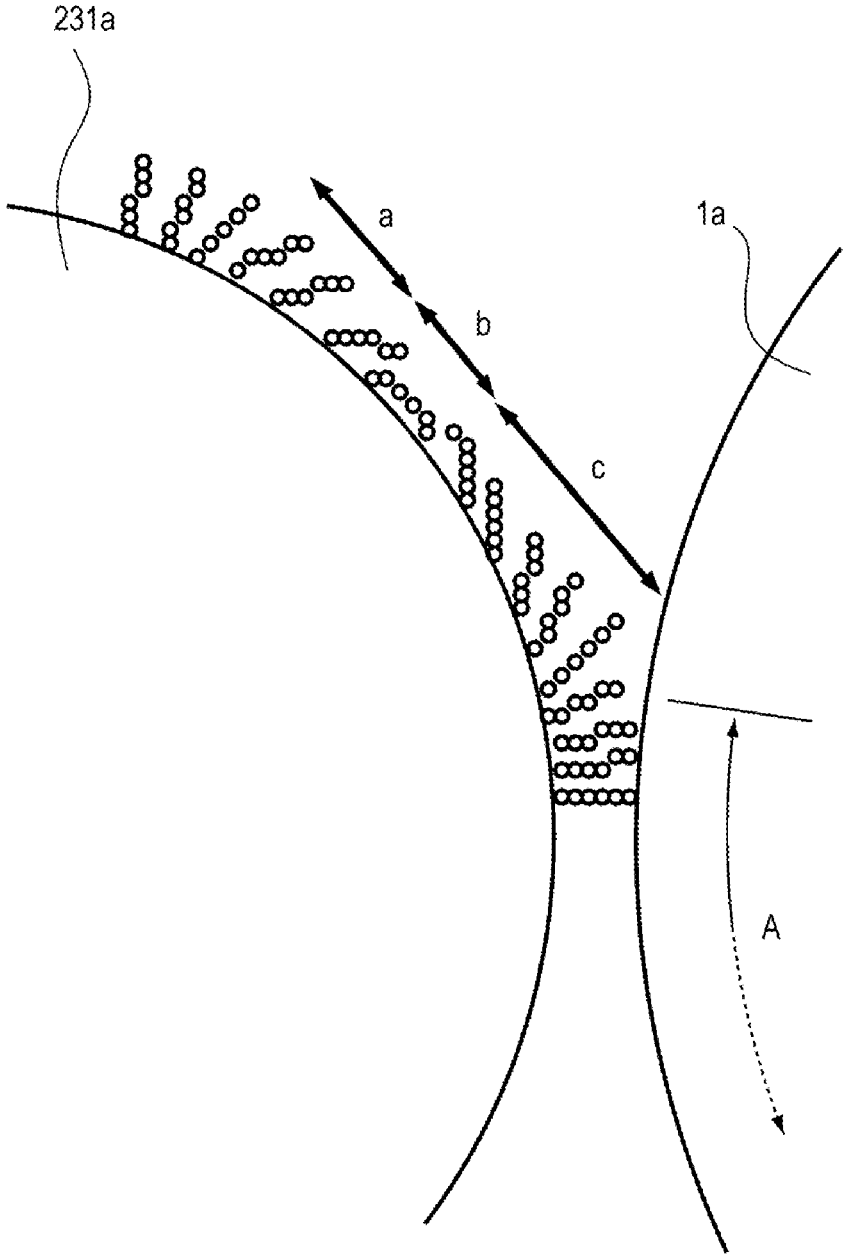
FIG. 5 is a view illustrating a voltage applying range of the auxiliary electrode.

FIG. 5 is a view illustrating the voltage applying range of the auxiliary electrode 235*a*. As illustrated in FIG. 5, when the pre-bias is applied to a region a located on the most upstream side of a development region A in the developer conveying direction, the developer at leading end of a magnetic ear in which the toner concentration is increased is inverted in a next magnetic pole position. Therefore, because the developer having the low toner concentration comes into contact with the photosensitive drum 1*a* in the development region A, a development property is degraded.

When the pre-bias is applied to a region b located on a downstream side of the development region a in the developer conveying direction, because the developer at the leading end of the magnetic ear is inverted, the magnetic ear lies down, and the toner is concentrated on a side surface of the magnetic ear. Therefore, the toner is reduced at the leading end of the magnetic ear, the development property is degraded.

When the pre-bias is applied to a region c located on the downstream side of the development region b in the developer conveying direction, the toner is attracted to the leading end of the magnetic ear, and the development is performed while the toner concentration is increased at the leading end of the magnetic ear. Therefore, the development property is improved.

As described above, the pre-bias is effectively applied to the position (position in the region c) closest to the development region A in the plural magnetic poles inside the developer bearing member located on the upstream side of the development region A in the developer conveying direction, and the magnetic ear starts to rise up in the position in the region c that faces a development main pole.

Figure 6A:
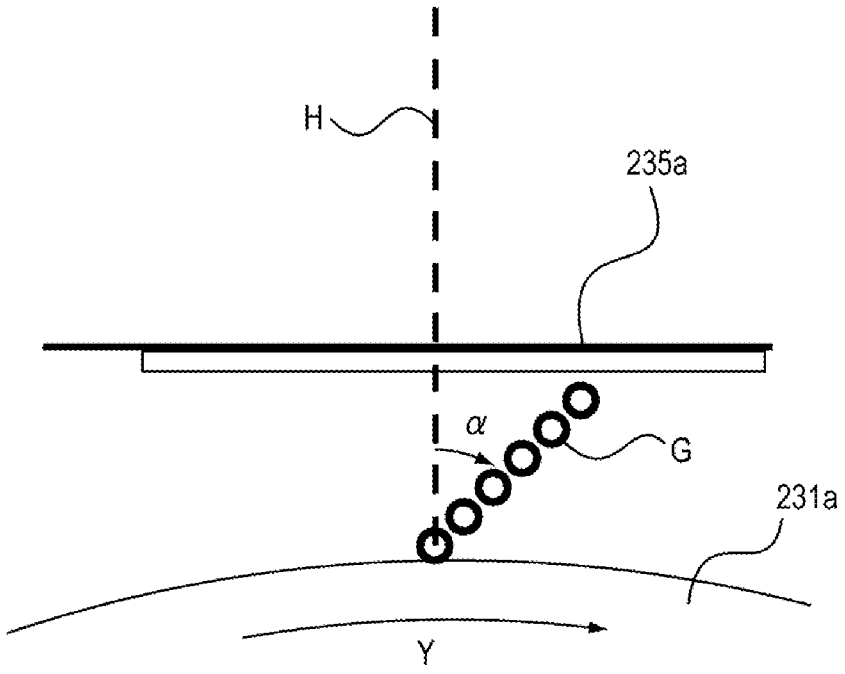
FIGS. 6A and 6B are views describing a force acting on toner.
Figure 6B:
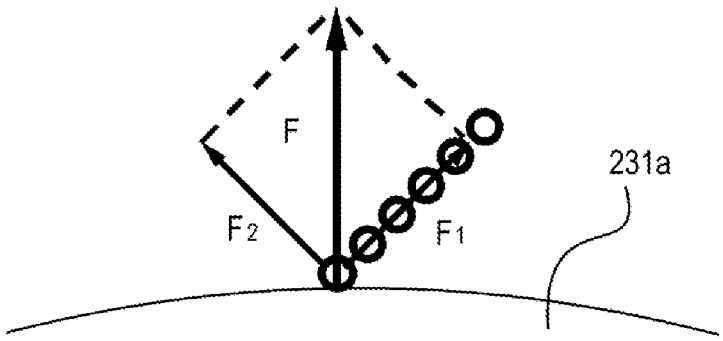

The following discussion is performed in order to clarify a range where the effect of the pre-bias is exerted better. FIGS. 6A and 6B are views describing a force acting on the toner. As illustrated in FIG. 6A, it is assumed that an angle $\alpha$ is formed by an outward normal line H in a surface of the development sleeve 231*a* and a magnetic ear G in a plane including the developer conveying direction (a direction of an arrow Y). At this point, it is assumed that a positive direction of $\alpha$ is a direction in which the magnetic ear G is tilted in the developer conveying direction relative to the outward normal line H in the surface of the development sleeve 231*a*.

It is assumed that parallel plate approximation holds to form the electric field perpendicular to the auxiliary electrode 235*a* in the position in which the development sleeve 231*a* and the auxiliary electrode 235*a* face each other. When the magnetic ear G has the angle $\alpha$ as illustrated in FIG. 6A, a force F that toner particles in the magnetic ear receive by the electric field can be resolved into a force $f_1$ that pulls the toner particles toward the leading end of the magnetic ear and a force $f_2$ that attracts the toner particles to the side surface of the magnetic ear as illustrated in FIG. 6B.

In the range of $-45° < \alpha < 45°$, because the force $f_1$ that pulls the toner particles toward the leading end of the magnetic ear is stronger than the force $f_2$ that attracts the toner particles to the side surface of the magnetic ear, a force that concentrates the toner on the leading end of the magnetic ear G acts on the toner in the developer to exert the effect of the pre-bias.

$\alpha \approx \tan^{-1}(B_\theta/B_r)$ holds because a shape of the magnetic ear G substantially follows a pattern of magnetic flux density generated around the development sleeve 231*a*. $B_r$ is a development sleeve surface normal direction component of the magnetic flux density. $B_\theta$ is a developer conveying direction component of the magnetic flux density. $B_\theta$ is a developer conveying direction component of the magnetic flux density.

Figure 7:
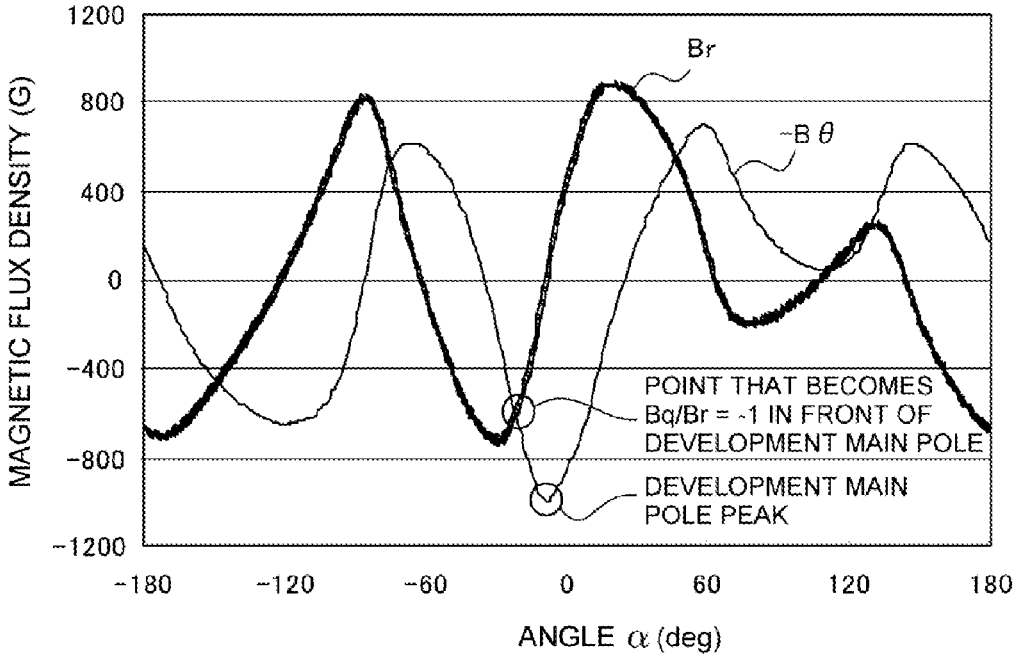
FIG. 7 is a view illustrating a magnet pattern.

FIG. 7 is a view illustrating a relationship between the angle $\alpha$ formed by the magnetic ear G and the magnetic flux density $B_\theta$ and $B_r$. Referring to FIG. 7, in the developer conveying direction, the angle $\alpha$ comes close to 0 from a negative value as the angle $\alpha$ comes close to the development main pole. Accordingly, near the development main pole, a position of $\alpha = -45°$, namely, a point (intersection point of two curved lines $B_r$ and $-B_\theta$) in which $B_\theta/B_r = -1$ is obtained is set to a pre-bias application starting point. In the first embodiment, because a peak of the development main pole is located at $\alpha = -8°$, the pre-bias application starting point can be set to $-21°$.

A pre-bias application ending point is determined as follows. While the effect that the bias attracts the toner is increased with increasing bias applying range, an amount of toner put on the photosensitive drum by the development is increased with decreasing contact distance between the magnetic brush (magnetic ear G) and the photosensitive drum 1*a*. Therefore, the bias applying range extends from the bias application starting point, the amount of toner put on the photosensitive drum 1*a* is increased until the point in which the magnetic brush and the photosensitive drum 1*a* come into contact with each other. However, the amount of toner put on the photosensitive drum 1*a* is decreased when the electrode invades in the development region A to narrow the contact range of the magnetic brush and the photosensitive drum 1*a*. Therefore, the contact start point of the magnetic brush and the photosensitive drum 1*a* is set to the bias application ending point such that the amount of toner put on the photosensitive drum 1*a* becomes the maximum.

A region between the pre-bias application starting point and the pre-bias application ending point is set to the pre-bias applying range, and the width d of the electrode portion 236*a* is matched with the pre-bias applying range.

(Bias Applied to Auxiliary Electrode 235*a*)

The bias applied to the auxiliary electrode 235*a* will be described. In the first embodiment, it is assumed that a development electric field $E_{dev}$ is the electric field in the point in which the distance with the photosensitive drum 1*a* becomes the shortest in the region where the development sleeve 231*a* and the photosensitive drum 1*a* face each other. Similarly it is assumed that a pre-bias field intensity $E_{pre}$ is the electric field in the point in which the distance with the auxiliary electrode 235*a* becomes the shortest in the region where the development sleeve 231*a* and the auxiliary electrode 235*a* face each other.

As described above, in the two-component DC development method, because the development electric field is smaller than the development electric field that is generally used in the two-component AC development method, the small amount of toner contributes to the development. Because the development electric field is increased with increasing DC development bias, the adhesion of the carrier to the image region becomes prominent although the image density is increased. When the carrier adheres to the image region on the photosensitive drum, the carrier emerges as a black spot in an output image. In the first embodiment, an upper limit of the carrier adhesion amount is determined to one carrier/$cm^2$.

Figure 8:
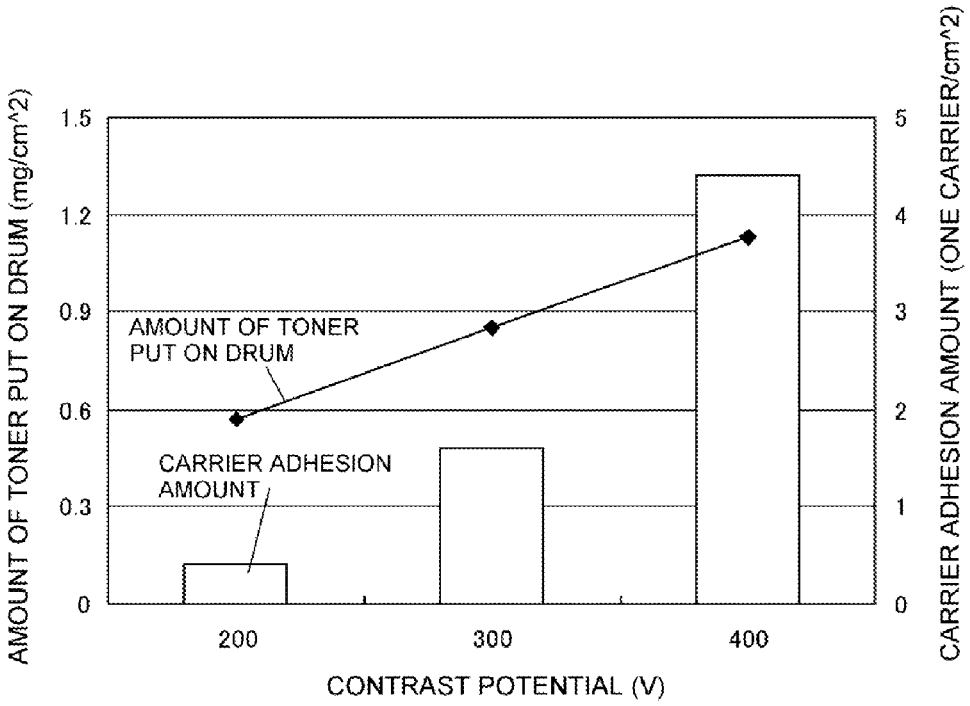
FIG. 8 is a view illustrating contrast potential dependence of an amount of toner put on a photosensitive drum and a carrier adhesion amount.

FIG. 8 is a view illustrating dependence of the amount of toner put on the photosensitive drum and the amount of carrier adhering to the image region of the photosensitive drum on the development bias (contrast potential). As illustrated in FIG. 8, when the development bias (contrast potential) is increased, although the amount of toner put on the photosensitive drum is increased, the amount of carrier adhering to the image region of the photosensitive drum 1*a* is rapidly increased from the voltage of 300 V to 400 V.

On the other hand, when the pre-bias voltage is increased, because the electric field intensity is similarly increased, the amount of toner moved between the development sleeve 231*a* and the auxiliary electrode 235*a* is increased. At the same time, even if the movement of the carrier is generated, because a destination of the carrier particle is the surface of the electrode portion, the carrier does not emerge in the output image unlike the increase in development bias. Therefore, the increase in voltage applied between the auxiliary electrode 235*a* and the development sleeve 231*a* can increase the image density while suppressing a risk that the carrier adheres to the image region on the photosensitive drum.

Figure 9:
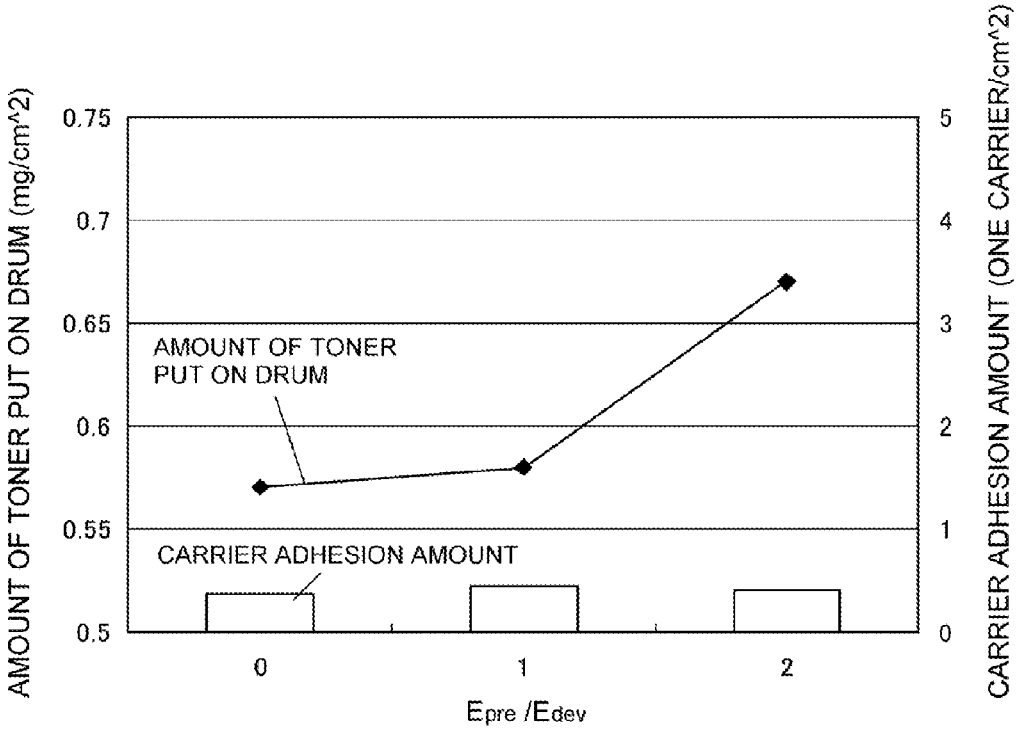
FIG. 9 is a view illustrating pre-bias dependence of the amount of toner put on the photosensitive drum and the carrier adhesion amount.

FIG. 9 is a view illustrating pre-bias dependence of the amount of toner put on the photosensitive drum and the amount of carrier adhering to the image region of the photosensitive drum. A horizontal axis of FIG. 9 indicates a ratio of the pre-bias field intensity $E_{pre}$ to the development electric field $E_{dev}$.

The amount of toner put on the photosensitive drum is increased when the pre-bias electric field is increased relative to the development electric field. Although the amount of toner put on the photosensitive drum is not largely changed when the pre-bias electric field is equal to or lower than the development electric field, the amount of toner put on the photosensitive drum is rapidly increased when the pre-bias electric field exceeds the development electric field. Even if the pre-bias electric field is changed, the amount of carrier adhering to the image region on the photosensitive drum is hardly changed.

A difference in development property between the two-component AC development method and the two-component DC development method is discussed using the following model in order to clarify what effect is generated by increasing the pre-bias electric field compared with the development electric field.

As is well known, in the development region A where the photosensitive drum 1*a* and the development sleeve 231*a* face each other, the toner is developed in the surface of the photosensitive drum 1*a* by properly applying the voltage between the photosensitive drum 1*a* and the development sleeve 231*a*, and the development is ended at the time forces acting on the toner particle are matched. Examples of the force acting on the toner particle include a force generated by the electric field formed in the development region and an electrostatic/non-electrostatic force between the toner and the carrier.

Because the AC development has the large intensity of the development electric field compared with the DC development, a development speed is fast, and a time until the development ended is short. In the AC development, the effect that the toner and the carrier are separated by the AC component of the development bias is increased, and the large amount of toner contributes to the development. Therefore, the large amount $M_\infty$ of toner is finally developed after the development is ended.

Figure 10A:
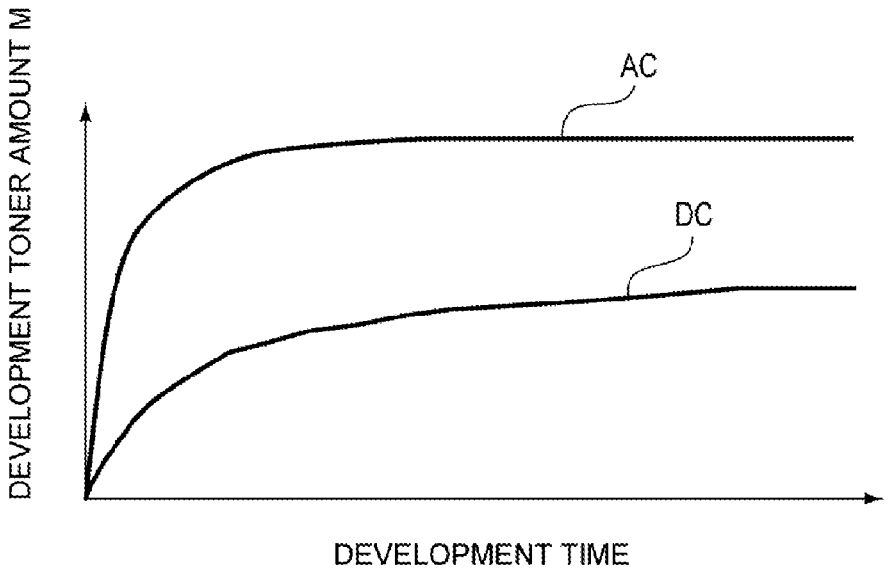
FIGS. 10A and 10B are views illustrating a relationship between a development time and an amount of toner to be developed.

Therefore, it is assumed that a plot of FIG. 10A is obtained as a function of an amount M of toner developed by the photosensitive drum 1*a* and a development time.

The development time can extend by broadening the contact range of the magnetic brush and the photosensitive drum 1*a* in the development region A such that a diameter of one of the development sleeve 231*a* and the photosensitive drum 1*a* is increased. In the first embodiment, the development time is expressed by $t_{dev}$.

Figure 10B:
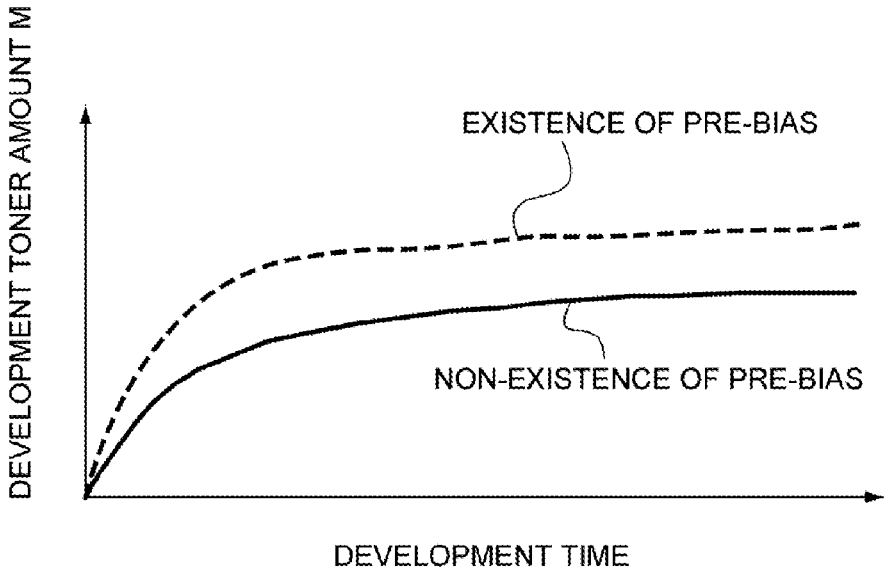

Pulling the toner in the developer onto the photosensitive drum side with the auxiliary electrode 235*a* corresponds to increasing the amount of toner contributing to the development, and has an effect that a curved line of the DC development of FIG. 10A is shifted like a dotted line of FIG. 10B.

Figure 11A:
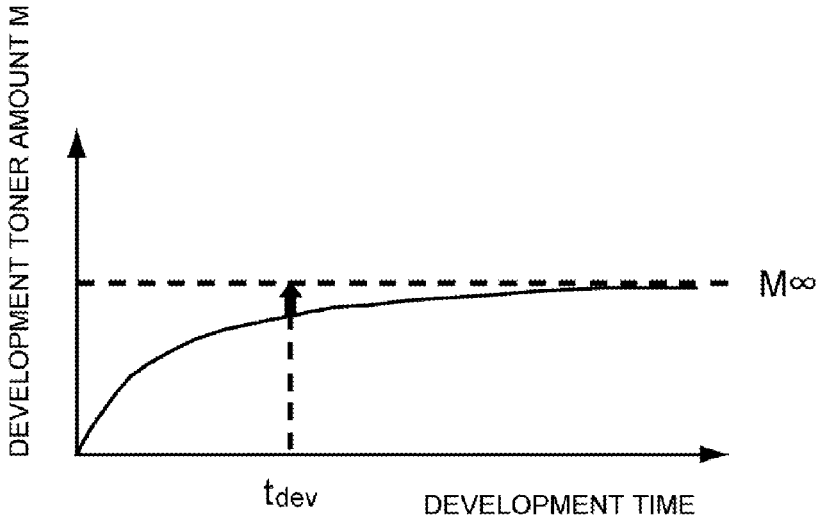
FIGS. 11A and 11B are views illustrating the relationship between the development time and the amount of toner to be developed.

As described above, when the development is performed under the development electric field while plenty of time is taken, the amount $M_\infty$ of toner is developed from the development sleeve 231*a* to the photosensitive drum 1*a*. When the electric field formed by the pre-bias is equal to the development electric field, it is found that at most the amount $M_\infty$ of toner is concentrated on the leading end of the magnetic ear by the pre-bias. Therefore, the amount of toner developed on the photosensitive drum is equal to or smaller than the toner amount $M_\infty$. When the electric field formed by the pre-bias is equal to the development electric field, the amount of toner developed on the photosensitive drum does not exceed the toner amount $M_\infty$ as illustrated in FIG. 11A. Because actually the time in which the developer passes by the position of the auxiliary electrode and the development time are finite, the amount of toner concentrated on the leading end of the magnetic ear G is further decreased.

Figure 11B:
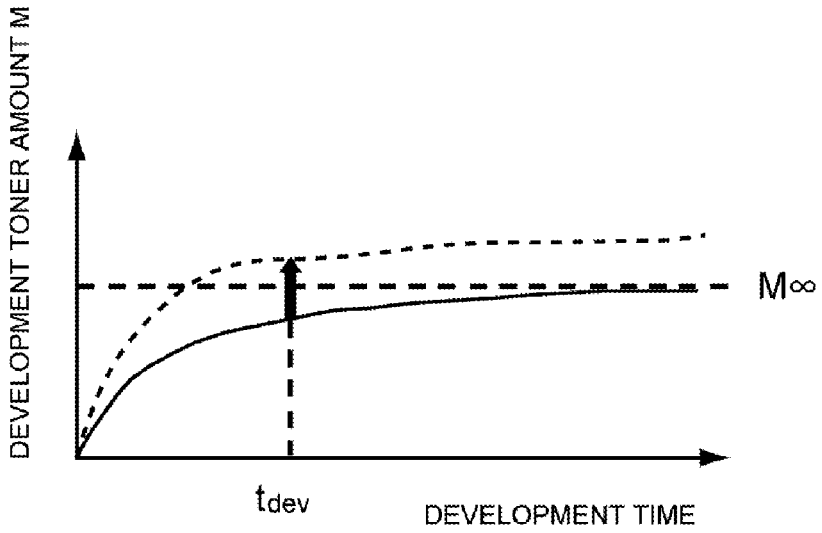

However, when the pre-bias is applied such that the electric field larger than the development electric field is formed, because the amount of toner larger than the amount of toner developed on the photosensitive drum in the normal development can be concentrated on the leading end of the magnetic ear, the amount of toner equal to or larger than the toner amount $M_\infty$ can be developed as illustrated in FIG. 11B.

In the first embodiment, a dark portion potential $V_d$ and a bright portion potential $V_1$ of the electrostatic latent image on the photosensitive drum 1*a* are set to −700 V and −300 V, respectively. The DC voltage of −500 V is applied to the development sleeve 231*a* during the development. The voltage of 200 V is applied between the photosensitive drum 1*a* and the development sleeve 231*a* during the development. In the case of a distance of 300 μm in the closest portion between the photosensitive drum 1*a* and the development sleeve 231*a*, assuming that the parallel plate approximation holds in the closest portion between the photosensitive drum 1*a* and the development sleeve 231*a*, the development electric field is $6.7\times10^5$ V/m.

When the electrode portion 236*a* of the auxiliary electrode 235*a* is grounded, a potential difference with the development sleeve 231*a* is 500 V. When the electrode portion 236*a* is disposed 600 μm away from the development sleeve 231*a*, the electric field of $8.3\times10^5$ V/m is generated between the development sleeve 231*a* and the electrode portion 236*a*. The electric field intensity can be increased by bringing the electrode portion 236*a* close to the development sleeve 231*a*. However, when the electrode portion 236*a* is excessively brought close to the development sleeve 231*a*, a discharge is generated between the electrode portion 236*a* and the development sleeve 231*a*. When the discharge is generated, the electric field is eliminated, and the toner cannot be attracted.

In the first embodiment, the distance between the electrode portion 236*a* and the development sleeve 231*a* is adjusted within a range of 300 to 700 μm, a discharge starting voltage is calculated from the distance by Paschen's law, and the calculated discharge starting voltage is set to the upper limit of the pre-bias voltage.

As described above, according to the first embodiment, instead of grounding the electrode, the pre-bias (DC bias) may be applied such that the electric field larger than the development electric field is formed between the development sleeve 231*a* and the auxiliary electrode 235*a* on the upstream side of the development region A in the developer conveying direction. Therefore, the toner concentration in the surface of the developer is increased and the image density can further be increased.

Figure 12A:
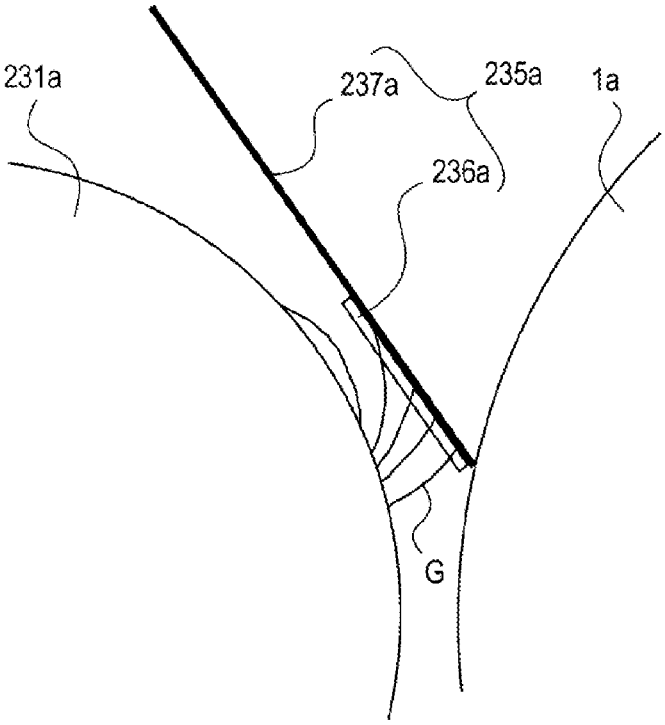
FIG. 12A is a view illustrating a state of a magnetic field line between a developer bearing member and an electrode member when a magnetic plate is not provided.
Figure 12B:
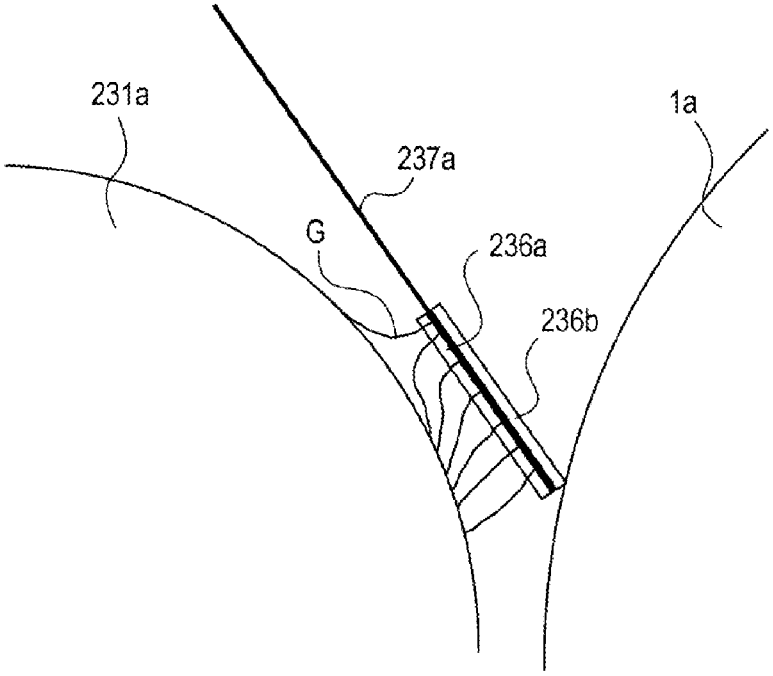
FIG. 12B is a view illustrating the state of the magnetic field line between the developer bearing member and the electrode member when the magnetic plate is provided.
Figure 13:
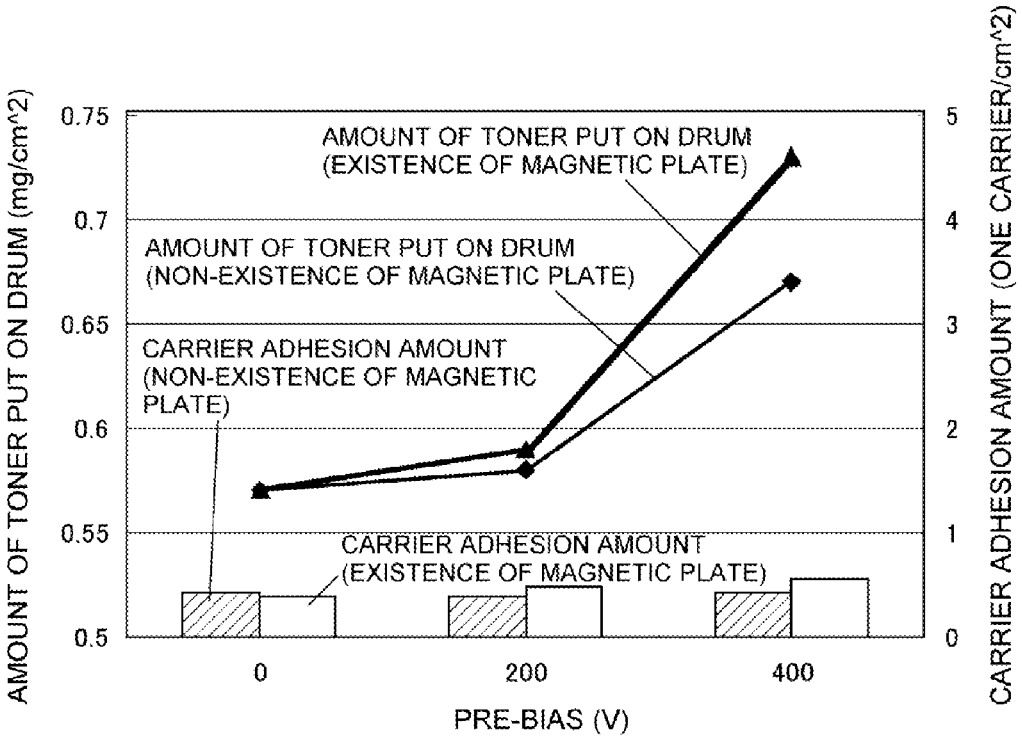
FIG. 13 is a view illustrating an effect of a magnetic plate according to a second embodiment.

[Second Embodiment] A development device and an image forming apparatus according to a second embodiment of the invention will be described with reference to the drawings. The same component as the first embodiment is designated by the same numeral, and the description is not repeated. FIG. 12A is a view illustrating a state of a magnetic field line between the development sleeve 231*a* and the auxiliary electrode 235*a* when a magnetic plate 236*b* is not provided. FIG. 12B is a view illustrating the state of the magnetic field line between the development sleeve 231*a* and the auxiliary electrode 235*a* when the magnetic plate 236*b* is provided. FIG. 13 is a view illustrating the pre-bias dependence of the amount of toner put on the photosensitive drum and the amount of carrier adhering to the image region on the photosensitive drum when the magnetic plate 236*b* is placed and not placed.

As illustrated in FIG. 12B, in the image forming apparatus of the second embodiment, the magnetic plate 236*b* is attached to the auxiliary electrode 235*a* of the first embodiment.

As illustrated in FIG. 12A, when the magnetic plate 236*b* is not provided, a portion in which the developer insufficiently ears up exists in the upstream side in the developer conveying direction within the bias applying range.

As illustrated in FIG. 12B, when the magnetic plate 236*b* is provided, because the shape of the magnetic ear G substantially follows a vector field of a magnetic field, the magnetic ear G within the bias applying range comes substantially perpendicular into contact with the auxiliary electrode 235*a*.

Therefore, the developer on the development sleeve includes a gap between the magnetic ear G and the magnetic ear G, a resistance applied to the toner particle from the surrounding developer is reduced when the toner particle moves in the developer by the action of the pre-bias, and mobility of the toner is increased. As illustrated in FIG. 13, the toner can efficiently be moved to the leading end of the magnetic ear G by applying the pre-bias.

That is, when the magnetic plate 236*b* is attached to the auxiliary electrode 235*a*, the developer ears up within the bias applying range, the effect that the toner is attracted by the bias is easily obtained, and the magnetic field line within the bias applying range is oriented toward the auxiliary electrode 235*a*.

According to the invention, the voltage is applied such that the electric field larger than the development electric field is formed between the developer bearing member and the electrode member on the upstream side of the development region in the developer conveying direction, and the toner concentration on the surface of the developer is increased, which allows the image density to be further increased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-013965, filed Jan. 26, 2011, which is hereby incorporated by reference herein in its entirety.

What is claimed is:

1. A development device comprising:

a developer bearing member that is disposed opposite an image bearing member bearing an electrostatic latent image, and conveys a developer having toner and a carrier to a development region;

a first bias applying portion that applies a first DC voltage to the developer bearing member;

an electrode member that is disposed on an upstream side of the development region in a developer conveying direction;

a second bias applying portion that applies a second DC voltage to the electrode member; and a controller that controls the first bias applying portion and the second bias applying portion such that a first electric field intensity formed between the electrode member and the developer bearing member by a potential difference between the second DC voltage and the first DC voltage is larger than a second electric field intensity formed between the image bearing member and the developer bearing member by a potential difference between a potential at an image portion of the image bearing member and the first DC voltage, wherein the first electric field intensity between the electrode member and the developer bearing member is smaller than a discharge starting voltage between the electrode member and the developer bearing member.

2. The development device according to claim 1, further comprising an electrode support member that supports the electrode member, wherein a magnetic plate is provided at a surface on an opposite side to the developer bearing member side of the electrode member.

3. A development device comprising:

a developer bearing member that is disposed opposite an image bearing member bearing an electrostatic latent image, and conveys a developer having toner and a carrier to a development region;

a first bias applying portion that applies a first DC voltage to the developer bearing member;

an electrode member that is disposed to face the developer bearing member;

a second bias applying portion that applies a second DC voltage to the electrode member;

a controller that controls the first bias applying portion and the second bias applying portion such that a first electric field intensity formed between the electrode member and the developer bearing member is larger than a second electric field intensity formed between the image bearing member and the developer bearing member; and a magnet equipped with plurality of magnetic poles, wherein the electrode is disposed at an upstream side, with respect to a developer bearing member moving direction, from a position where the image bearing member and the developer bearing member are closest to each other, and faces a region at a downstream side of a position of the developer bearing member where a magnetic flux density Br in a direction of a normal line component of the developer bearing member and a magnetic flux density Bθ in a direction of a tangent line component of the developer bearing member, among magnetic flux densities which the magnet provides on a surface of the developer bearing member, first become equal.

4. The development device according to claim 3, wherein a position where the electrode is disposed is at an upstream side of a position where the developer borne by the developer bearing member starts to contact with the image bearing member.

* * * * *